US006597128B2

(12) United States Patent
Flory, IV et al.

(10) Patent No.: US 6,597,128 B2
(45) Date of Patent: Jul. 22, 2003

(54) REMOTE DISCHARGE LAMP IGNITION CIRCUITRY

(75) Inventors: Isaac Lynnwood Flory, IV, Blacksburg, VA (US); Christopher Allen Hudson, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 15 days.

(21) Appl. No.: 09/969,101

(22) Filed: Oct. 3, 2001

(65) Prior Publication Data

US 2003/0062853 A1 Apr. 3, 2003

(51) Int. Cl.[7] ..... H05B 41/16; H05B 41/14

(52) U.S. Cl. ..... 315/289; 315/290; 315/227 R

(58) Field of Search ..... 315/227 R, 209 CD, 315/289, 290, 177, 240–244, 207, 208, 276–278

(56) References Cited

U.S. PATENT DOCUMENTS

| | | | | | |
|---|---|---|---|---|---|
| 2,182,609 | A | | 12/1939 | Bethenod | 176/124 |
| 2,659,037 | A | | 11/1953 | Claude | 315/233 |
| 3,917,976 | A | | 11/1975 | Nuckolls | 315/258 |
| 3,963,958 | A | | 6/1976 | Nuckolls | 315/276 |
| 4,005,336 | A | | 1/1977 | Casella | 315/239 |
| 4,184,103 | A | | 1/1980 | Stein | 315/276 |
| 4,339,695 | A | * | 7/1982 | Siglock | 315/276 |
| 4,415,837 | A | | 11/1983 | Sodini | 315/177 |
| 4,461,982 | A | * | 7/1984 | Fahnrich | 315/290 |
| 4,644,228 | A | * | 2/1987 | Nilssen | 315/242 |
| 4,695,771 | A | | 9/1987 | Hallay | 315/290 |
| 4,742,278 | A | * | 5/1988 | Iannini | 315/227 R |
| 4,876,486 | A | | 10/1989 | Joahino | 315/290 |
| 4,950,961 | A | | 8/1990 | Zaslavsky et al. | 315/289 |
| 4,958,107 | A | | 9/1990 | Mattas et al. | 315/289 |
| 5,013,977 | A | | 5/1991 | Droho | 315/289 |
| 5,047,694 | A | | 9/1991 | Nuckolls et al. | 315/290 |
| 5,057,752 | A | | 10/1991 | Grabner et al. | 315/289 |
| 5,084,655 | A | | 1/1992 | Van Zanten | 315/290 |
| 5,089,745 | A | * | 2/1992 | Iannini | 315/76 |
| 5,210,471 | A | | 5/1993 | Nuckolls et al. | 315/289 |
| 5,321,338 | A | | 6/1994 | Nuckolls et al. | 315/290 |
| 5,563,473 | A | | 10/1996 | Mattas et al. | 315/240 |
| 5,694,006 | A | | 12/1997 | Konopka | 315/219 |
| 5,801,494 | A | * | 9/1998 | Herres et al. | 315/289 |
| 5,896,013 | A | | 4/1999 | Leskovec | 315/171 |
| 5,945,784 | A | | 8/1999 | Mattas | 315/247 |
| 6,049,172 | A | | 4/2000 | Hirschmann et al. | 315/82 |
| 6,091,208 | A | | 7/2000 | Flory, IV | 315/290 |
| 6,181,081 | B1 | | 1/2001 | Hirschmann et al. | 315/289 |

FOREIGN PATENT DOCUMENTS

| | | |
|---|---|---|
| GB | 2060287 | 4/1981 |

* cited by examiner

*Primary Examiner*—Don Wong
*Assistant Examiner*—Wilson Lee
(74) *Attorney, Agent, or Firm*—Christian C. Michel; Stacey J. Longanecker; Alfred N. Goodman

(57) ABSTRACT

A starter circuit is provided for starting an HID lamp. The circuit de-couples the high voltage starting pulse from the input lines (ballast output lines) so that the starter can function properly regardless of the distance between the ballast and the lamp.

41 Claims, 5 Drawing Sheets

REMOTE DISCHARGE LAMP IGNITION CIRCUITRY

FIELD OF THE INVENTION

The invention relates to a starting device for a discharge lamp, and in particular to a starting device for a high-pressure discharge lamp adapted to be located remotely from the ballast.

BACKGROUND OF THE INVENTION

High-Intensity Discharge (HID) lamps produce light by driving current through a gas filled arc-tube. A light emitting discharge arc is produced between two electrodes exposed within the arc-tube. A starting device is required to initiate the arc between the two electrodes. Typically, the starting device must produce a pulse of several kilovolts across the two electrodes in order to initiate the arc and start the lamp.

Many conventional HID lamps require a ballast and starting circuit to generate a starting pulse and to supply the operating lamp with the necessary operating current. Conventional starting circuits charge a capacitor to a certain value until an automatic switch closes allowing the capacitor to discharge through the primary winding of a transformer. The primary winding is inductively coupled to a secondary winding, and the combination of the rapidly discharging capacitor through the primary winding, along with the winding ratio of the secondary winding to the primary winding, generates a pulse of sufficient voltage and duration across the electrodes of the HID lamp to initiate operation. Unfortunately, conventional ballasts and starting circuits have to be located relatively close to the HID lamp because parasitic impedances in the conductors connecting the HID lamp to the starting circuit tend to attenuate the starting pulse. Because of this effect of parasitic impedances, many ballast manufacturers place a maximum "lamp-to-ballast" distance on every ballast-starter combination that is offered. These distances typically range from 2 to 75 feet, depending on the ballast and the ignitor circuit being used.

It would be advantageous to provide a starting circuit which is capable of starting and operating an HID lamp such that the lamp could be located at an unrestricted distance from the ballast.

SUMMARY OF THE INVENTION

The above-described disadvantages are overcome and other advantages are realized by providing a starting circuit in accordance with the present invention. According to the first embodiment of the invention, an ignitor circuit for a discharge lamp is provided which comprises a voltage input terminal, an ignitor output terminal, and a first capacitor having first and second capacitor terminals. The first capacitor terminal is connected to the voltage input terminal. The ignitor circuit further has a transformer having a primary winding inductively coupled to a secondary winding. An automatic switch is connected in series with the primary winding. The switch and primary winding are connected across the first capacitor, and the secondary winding is connected between the starting circuit voltage input terminal and the output or "lamp" terminal. A resistor is connected between the second capacitor terminal and the common terminal, and the second capacitor is connected across the resistor. The second capacitor is selected to have a value such that it represents a low impedance path for the high-frequency pulse generated by the transformer. Therefore, the pulse is de-coupled from the input lines and is presented across the electrodes of the discharge lamp.

In another embodiment of the present invention, an ignitor circuit for a discharge lamp is provided that comprises input terminals, an ignitor output terminal and a first capacitor having first and second capacitor terminals. The first capacitor terminal is connected to one of the input terminals. The ignitor circuit also has a transformer having a primary winding inductively coupled to a secondary winding. Furthermore, an automatic switch is connected in series with the primary winding, such that the switch and primary winding are connected across the first capacitor. The secondary winding is connected to the voltage input terminal and the ignitor output terminal. A resistor is connected between the second capacitor terminal and a common terminal, and a second capacitor is connected between the first input terminal and the second input terminal. In this embodiment the second capacitor presents a low impedance path for the high-voltage pulse generated by the transformer such that the pulse is applied across the terminals of the HID lamp.

In the third embodiment of the invention, an ignitor circuit for a discharge lamp is provided that comprises a voltage input terminal, an ignitor output terminal, and a transformer having a primary winding inductively coupled to a secondary winding. A resonant circuit is connected between the voltage input terminal and a common terminal, wherein the resonance circuit comprises the primary winding connected in series with an automatic switch and a first capacitor. The first capacitor is connected to the voltage input terminal. A second capacitor is connected in series to the secondary winding, such that the second capacitor and secondary winding are connected across the ignitor terminal and the common terminal. Finally, and inductor device is connected between the voltage input terminal and the ignitor terminal. In this manner, the high-frequency pulse generated in the secondary winding of the transformer is present across the terminals of the discharge lamp through the low impedance path of the secondary capacitor. Furthermore, the pulse is de-coupled from the input terminals by the inductor.

BRIEF DESCRIPTION OF THE DRAWINGS

These and other advantages and novel features of the invention will be more readily appreciated from the following detailed description and in conjunction with the accompanying drawings in which.

Throughout the drawing figures, the same reference numerals will be understood to refer to the same parts or components.

DETAILED DESCRIPTION OF THE INVENTION

Figure 1:
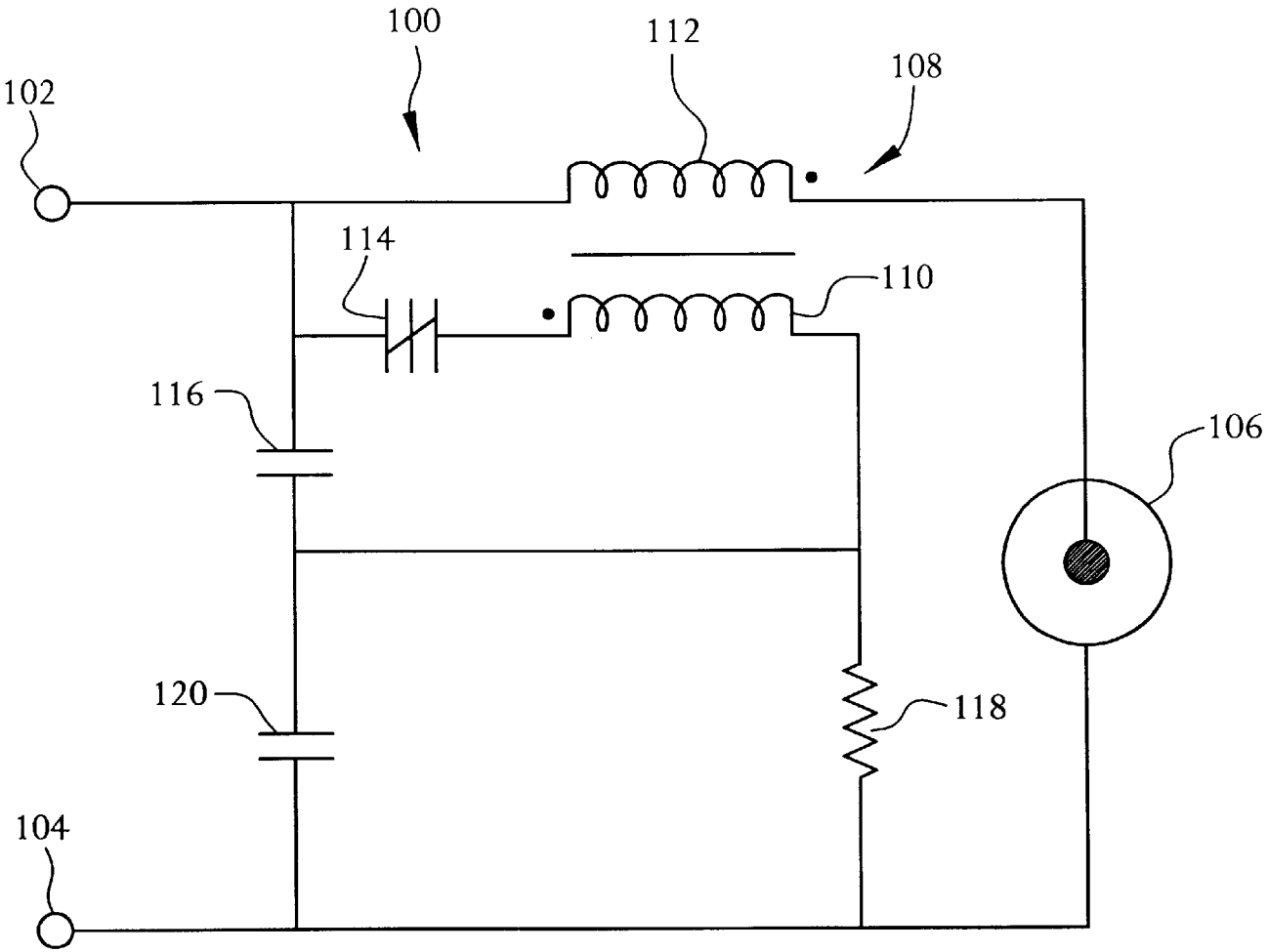
FIG. 1 is a circuit diagram of a first embodiment of the invention.

An ignition circuit 100 according to the present invention is illustrated in FIG. 1. The circuit 100 includes a voltage input terminal 102 and a common terminal 104. These input terminals are preferably connected to the outputs of a ballast, which can be located at any distance from the starting circuit due to the de-coupling nature of the circuit design. The circuit 100 also includes an HID lamp 106. The circuit also includes a transformer 108 comprising a primary winding 110 and a secondary winding 112. The primary winding of the transformer 108 is connected in series with an automatic switch 114. The automatic switch preferably has a break-over voltage of 240V. However, a wide range of possible break-over voltages are contemplated to be within the scope of the invention. A first capacitor 116 is connected across the primary winding 110 and the automatic switch 114. The capacitor preferably has a value of 0.33 uF. A first terminal of the first capacitor 116 is connected to the voltage input terminal 102. The secondary winding 112 of the transformer 108 is also connected to the voltage input terminal 102. The other terminal of the secondary winding 112 is connected to one terminal of the HID lamp 106. A resistor 118, preferably 5 k ohms, is connected between the first capacitor and the common terminal 104. Finally, a second capacitor 120 is connected across the resistor 118. The second capacitor 120 preferably has a value of 0.01 uF. It is to be understood that the values suggested for the capacitors are merely exemplary, and a wide range of possible values is contemplated to be within the scope of the invention.

In operation, the output of a ballast is applied to the voltage input terminal 102. Current through resistor 118 charges capacitor 116 until the voltage across automatic switch 114 reaches a break-over voltage. Once automatic switch 114 begins to conduct, current flows through a primary winding 110, inducing a voltage across primary winding 110. Due to transformer action, a corresponding voltage is induced across secondary winding 112. The high-frequency pulse across the secondary winding 112 is applied to the HID lamp 106. The voltage of the high-frequency pulse is determined by the winding ratio between the primary winding 110 and the secondary winding 112. The winding ratio is preferably 8 to 1 so that a pulse of sufficient voltage (preferably 3400V) is applied across HID lamp 106 to cause an arc between the exposed terminals in the lamp. The values of the first capacitor 116 and the second capacitor 120 are selected such that they present a low impedance path for the high-frequency pulse induced in secondary winding 112. Therefore, the high-frequency, high-voltage pulse is applied across the lamp terminals. Due to the low impedance path through the capacitors 116, 120, the pulse is de-coupled from the voltage input terminals 102 and 104.

Figure 2:
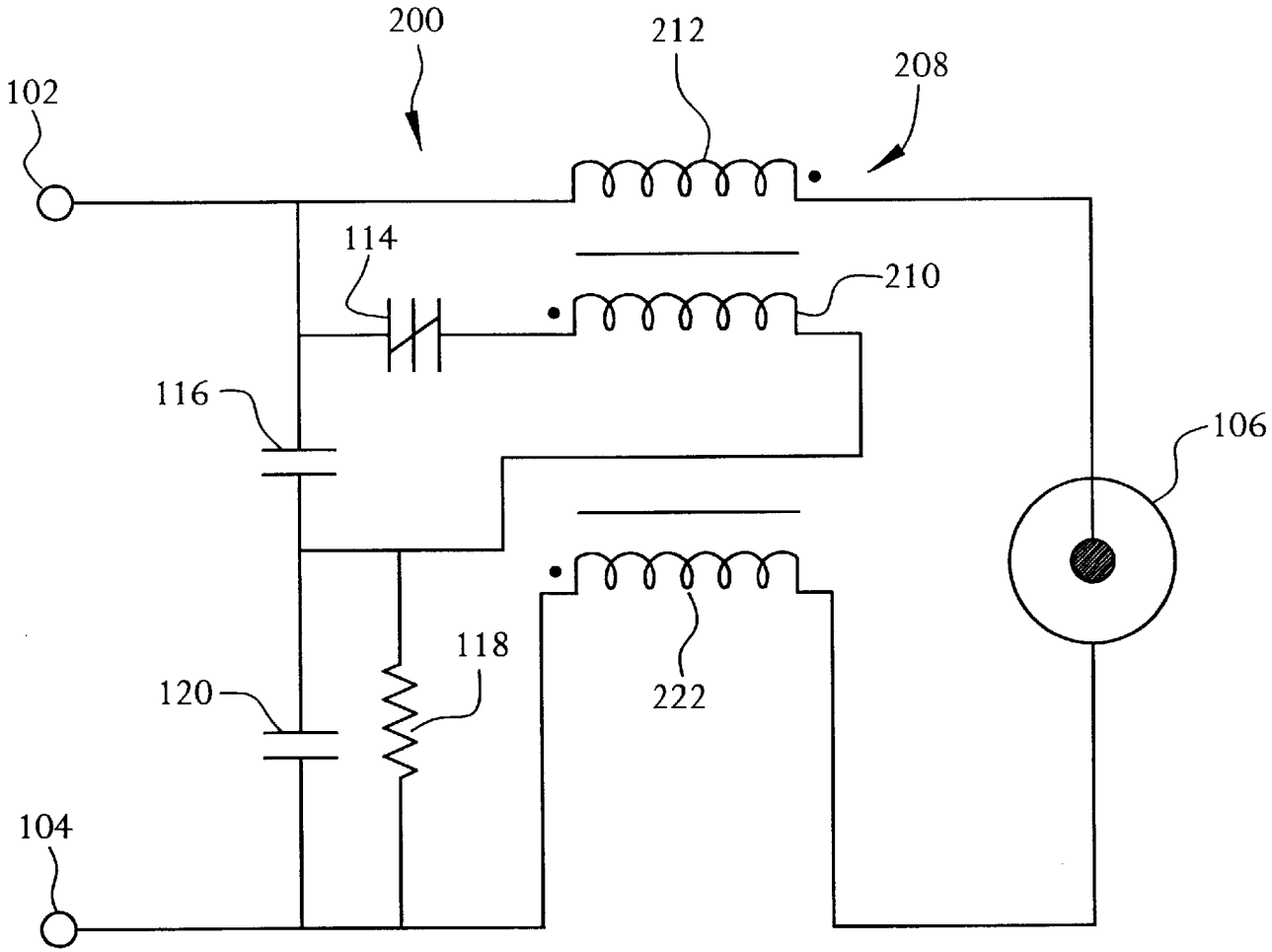
FIG. 2 is a circuit diagram of a first embodiment of the invention, including an optional tertiary winding.

FIG. 2 illustrates an embodiment of the present invention similar to FIG. 1 with the addition of an optional tertiary winding to the transformer. Transformer 208 includes primary winding 210 and secondary winding 212 connected in a manner similar to the transformer 108 depicted in FIG. 1. A tertiary winding 222 is added to the circuit 200 and connected between the common terminal 104 and the second terminal of the HID lamp 106. In this embodiment of the circuit, the winding ratio between the primary winding 210 and the secondary winding 212 is preferably 4 to 1. The winding ratio between the primary winding 210 and the tertiary winding 222 is also preferably 4 to 1. In this embodiment, when automatic switch 114 begins to conduct and the voltage across capacitor 116 is applied to primary winding 210, corresponding voltages are induced in both secondary winding 212 and tertiary winding 222. The voltages that are induced in secondary winding 212 and tertiary winding 222 are applied to the terminals of HID lamp 106. The values of capacitors 116 and 120 are selected such that they present a low impedance path to the high-frequency pulse generated in secondary winding 212 and tertiary winding 222. Thus, the high-frequency pulse is de-coupled from inputs 102 and 104.

Figure 3:
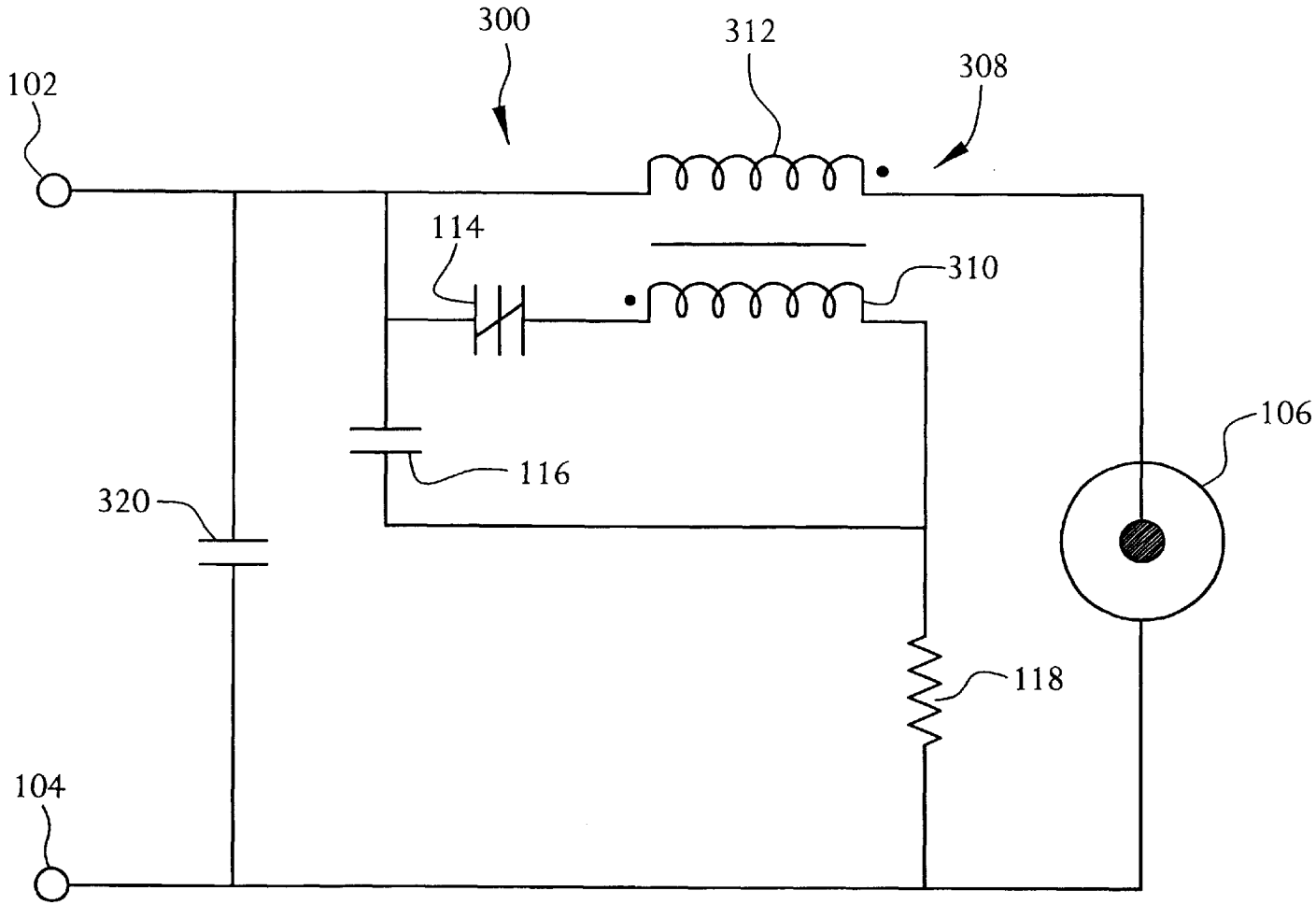
FIG. 3 is a circuit diagram of a second embodiment of the invention.

FIG. 3 illustrates a second embodiment of the present invention. The starter circuit 300 includes a voltage input terminal 102 and a common terminal 104. These input terminals are preferably connected to the outputs of a ballast, which can be located at any distance from the starting circuit due to the de-coupling nature of the circuit design. The circuit provides a high-voltage pulse to HID lamp 106. In order to begin an arc between the electrodes within the lamp enclosure, a transformer 308 is provided to generate the high-voltage pulse from stored energy via capacitor 116 received from the ballast or other voltage source. A primary winding 310 of the transformer 308 is connected in series with an automatic switch 114. A capacitor 116 is connected across the automatic switch 114 and the primary winding 310, and also has one of its terminals connected to the voltage input terminal 102. A resistor 118 is connected between the second terminal of the capacitor and the common terminal 104. Current through resistor 118 and capacitor 116 charges capacitor 116 until the voltage across it reaches the break-over voltage of automatic switch 114. When the voltage of capacitor 116 reaches the break over voltage, automatic switch 114 begins to conduct and capacitor 116 discharges rapidly through primary winding 310. Secondary winding 312 is inductively coupled to primary winding 310 such that a voltage is induced in secondary winding 312 which corresponds to the winding ratio between primary winding 310 and secondary winding 312. Capacitor 320 is connected between voltage input terminal 102 and common terminal 104. The value of capacitor 320 is selected such that it provides a low-impedance path for the high-frequency pulse induced in secondary winding 312 (preferably 0.01 uF). The high-voltage pulse is therefore applied across the terminals of HID lamp 106, and de-coupled from input terminals 102 and 104.

Figure 4:
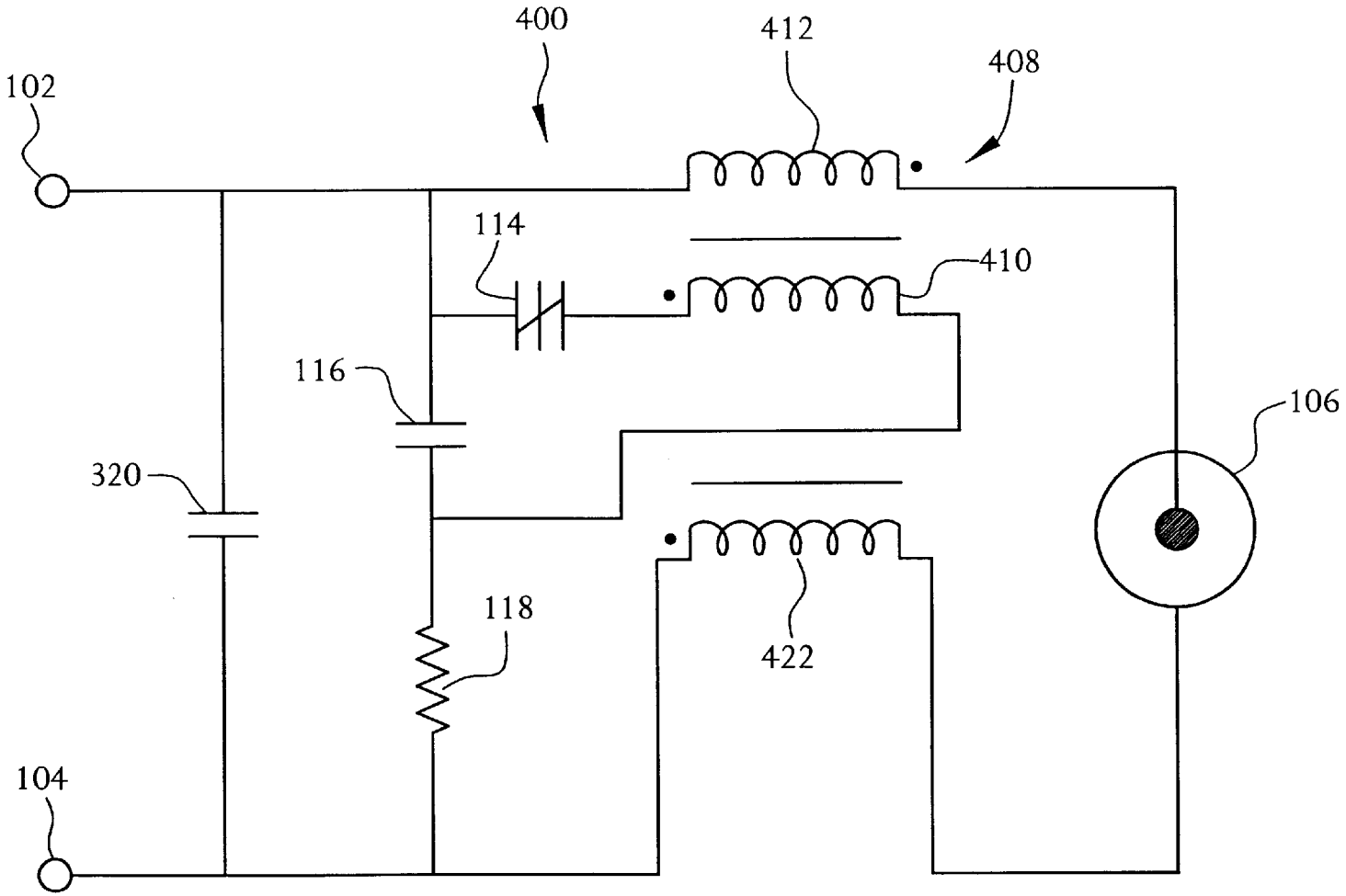
FIG. 4 is a circuit diagram of a second embodiment of the invention, including an optional tertiary winding.

An ignitor circuit in accordance with the second embodiment of the invention is illustrated in FIG. 4 and also comprises an optional tertiary winding 422. In the ignitor circuit depicted at 400, a three-winding transformer 408 delivers a high-voltage, high-frequency pulse to HID lamp 106. Capacitor 116 is charged until the voltage across the capacitor reaches the break-over voltage of automatic switch 114. When automatic switch 114 begins to conduct, the charge accumulated in capacitor 116 begins discharging through primary winding 410. A voltage appears across winding 410, and because primary winding 410 is inductively coupled to secondary winding 412 and tertiary winding 422, corresponding voltages are induced in the secondary and tertiary windings, respectively. The voltages induced in secondary winding 412 and tertiary winding 422 are related to the voltage induced in primary winding 410 by the winding ratio between the primary winding and the secondary winding and between the primary winding and the tertiary winding. Capacitor 320 is connected between voltage input terminal 102 and common terminal 104. The value of capacitor 320 is selected so that the high-voltage, high-frequency pulse generated in windings 412 and 422 has a low impedance path between the terminals of HID lamp 106.

Figure 5:
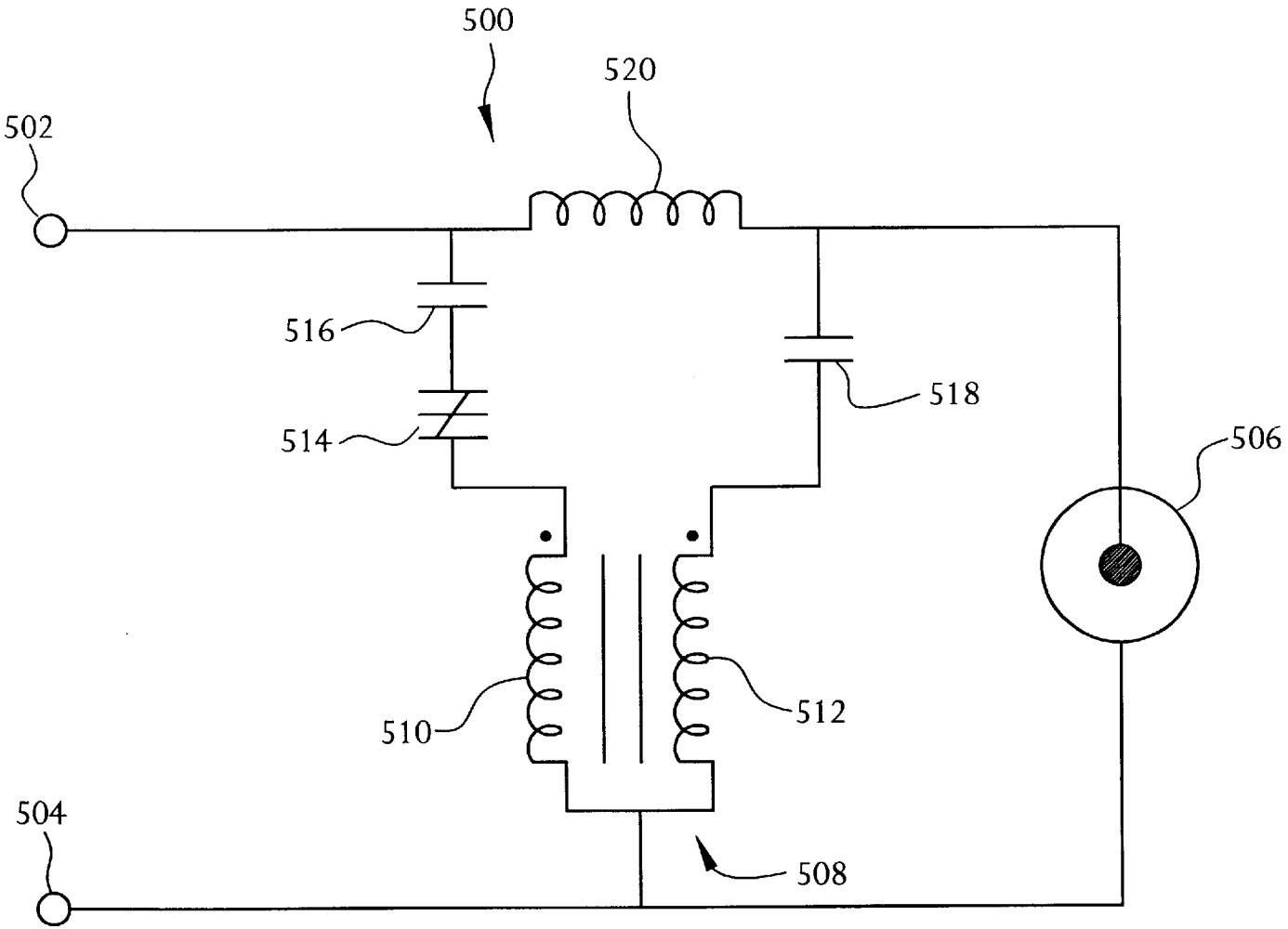
FIG. 5 is a circuit diagram of a third embodiment of the invention.

A third embodiment of the present invention is depicted in FIG. 5. Starter circuit 500 includes a voltage input terminal 502 and common terminal 504. The circuit 500 supplies a starting pulse to HID lamp 506. Transformer 508 includes primary winding 510 and secondary winding 512. Primary winding 510 forms part of a resonant circuit with capacitor 516, which is activated by automatic switch 514. As the voltage input terminal 502 increases, the voltage across automatic switch 514 also increases until the break-over voltage is reached, at which time automatic switch 514 begins conducting. When the automatic switch 514 begins conducting, current is forced through primary winding 510 inducing a voltage across winding 510. The values of capacitor 516 and the inductance of winding 510 and the electrical resistance of automatic switch 514 and primary winding 510 are selected so that a high frequency pulse is generated across winding 510 when the automatic switch 514 begins conducting.

Secondary winding 512 is inductively coupled to primary winding 510, so that a high-voltage pulse corresponding to the winding ratio between secondary winding in 512 and primary winding 510 is generated across secondary winding 512. Capacitor 518 is connected between HID lamp 506 and secondary winding 512. The value of capacitor 518 is selected such that the capacitor presents a low impedance path to the high frequency pulse induced in secondary winding 512. This high-frequency, high-voltage pulse is applied directly across HID lamp 506 causing an arc and starting the lamp. The high-voltage, high-frequency pulse is de-coupled from voltage input 502 by inductor 520 which is connected between the HID lamp and voltage input terminal 502.

What is claimed is:

1. An ignitor circuit for a discharge lamp, comprising:

a voltage input terminal;

an ignitor output terminal;

a first capacitor having first and second capacitor terminals, said first capacitor terminal being connected to said voltage input terminal;

a transformer having a primary winding inductively coupled to a secondary winding;

an automatic switch corrected in series with said primary winding, said switch and primary winding being connected across said first capacitor, said secondary winding being connected to said voltage input terminal and said ignitor output terminal;

a resistor connected between said second capacitor terminal and a common terminal; and a second capacitor connected across said resistor;

wherein said transformer includes a tertiary winding inductively coupled to said primary winding, said tertiary winding connected between said common terminal and a second ignitor output terminal.

2. An ignitor circuit for a discharge lamp, comprising:

a voltage input terminal;

an ignitor output terminal;

a first capacitor having first and second capacitor terminals, said first capacitor terminal being connected to said voltage input terminal;

a transformer having a primary winding inductively coupled to a secondary winding;

an automatic switch connected in series with said primary winding, said switch and primary winding being connected across said first capacitor, said secondary winding being connected to said first voltage terminal and said ignitor output terminal;

a resistor connected between said second capacitor terminal and a common terminal; and a second capacitor connected across said resistor;

wherein said automatic switch is a spark gap device.

3. An ignitor circuit as in claim 1, wherein said automatic switch is a semiconductor switch.

4. An ignitor circuit as in claim 1, wherein said discharge lamp is a high intensity discharge lamp.

5. An ignitor circuit as in claim 1, wherein said automatic switch switches at a voltage greater than the operating voltage of said discharge lamp.

6. An ignitor circuit as in claim 1, wherein said secondary winding is saturated at an input voltage frequency.

7. An ignitor circuit for a discharge lamp, comprising:

a voltage input terminal;

an ignitor output terminal;

a first capacitor having first and second capacitor terminals, said first capacitor terminal being connected to said voltage input terminal;

a transformer having a primary winding inductively coupled to a secondary winding;

an automatic switch connected in series with said primary winding, said switch and primary winding being connected across said first capacitor, said secondary winding being connected to said first voltage terminal and said ignitor output terminal;

a resistor connected between said second capacitor terminal and a common terminal; and a second capacitor connected across said resistor;

wherein said second capacitor is selected to provide a low impedance path for a starting pulse generated by said transformer.

8. An ignitor circuit for a discharge lamp, comprising:

a voltage input terminal;

an ignitor output terminal;

a first capacitor having first and second capacitor terminals, said first capacitor terminal being connected to said voltage input terminal;

a transformer having a primary winding inductively coupled to a secondary winding;

an automatic switch connected in series with said primary winding, said switch and primary winding being connected across said first capacitor, said secondary winding being connected to said voltage input terminal and said ignitor output terminal;

a resistor connected between said second capacitor terminal and a common terminal; and a second capacitor connected between said voltage input terminal and said common terminal.

9. An ignitor circuit as in claim 8, wherein said transformer includes a tertiary winding inductively coupled to said primary winding, said tertiary winding connected between said common terminal and a second ignitor output terminal.

10. An ignitor circuit as in claim 8, wherein said automatic switch is a spark gap device.

11. An ignitor circuit as in claim 8, wherein said automatic switch is a semiconductor switch.

12. An ignitor circuit as in claim 8, wherein said discharge lamp is a high intensity discharge lamp.

13. An ignitor circuit as in claim 8, wherein said automatic switch switches at a voltage greater than the operating voltage of said discharge lamp.

14. An ignitor circuit as in claim 8, wherein said secondary winding is saturated at an input voltage frequency.

15. An ignitor circuit as in claim 8, wherein said second capacitor is selected to provide a low impedance path for a starting pulse generated by said transformer.

16. An ignitor circuit for a discharge lamp, comprising:

a voltage input with a first and second input terminal;

an ignitor voltage output with a first and second ignitor output terminal;

a first capacitor having first and second capacitor terminals, said first capacitor terminal being connected to said first input terminal;

a transformer having a primary winding inductively coupled to a secondary winding and a tertiary winding wherein said secondary winding is connected to said first input terminal and said first ignitor output terminal, and said tertiary winding is connected to said second input terminal and said second ignitor output terminal;

an automatic switch connected in series with said primary winding, said switch and primary winding being connected across said first capacitor;

a resistor connected between said second capacitor terminal and said second input terminal; and a second capacitor connected across said resistor.

17. An ignitor circuit as in claim 16, wherein said second capacitor is selected to provide a low impedance path for a starting pulse generated by said transformer.

18. An ignitor circuit for a discharge lamp, comprising:

a voltage input with a first and second input terminal;

an ignitor voltage output with a first and second ignitor output terminal;

a first capacitor having first and second capacitor terminals, said first capacitor terminal being connected to said first input terminal;

a transformer having a primary winding inductively coupled to a secondary winding and a tertiary winding wherein said secondary winding is connected to said first input terminal and said first ignitor output terminal, and said tertiary winding is connected to said second input terminal and said second ignitor output terminal;

an automatic switch connected in series with said primary winding, said switch and primary winding being connected across said first capacitor;

a resistor connected between said second capacitor terminal and said second input terminal; and a second capacitor connected between said first input terminal and said second input terminal.

19. An ignitor circuit as in claim 18, wherein said second capacitor is selected to provide a low impedance path for a starting pulse generated by said transformer.

20. An ignitor circuit for a discharge lamp, comprising:

a voltage input terminal;

an ignitor output terminal;

a transformer having a primary winding inductively coupled to a secondary winding;

a resonant circuit connected between said voltage input terminal and a common terminal, wherein said resonant circuit comprises said primary winding connected in series with an automatic switch and a first capacitor, said first capacitor being connected to said voltage input terminal;

a second capacitor connected in series to said secondary winding, said second capacitor and secondary winding being connected across said ignitor output terminal and said common terminal; and an inductive device connected between said voltage input terminal and said ignitor output terminal.

21. An ignitor circuit as in claim 20, wherein said inductive device is saturated at an input voltage frequency.

22. An ignitor circuit as in claim 20, wherein said second capacitor is selected to provide a low impedance path for a starting pulse generated by said transformer.

23. A method of igniting a high intensity discharge lamp comprising the steps of:

providing a starting circuit at a distance from a ballast output, said starting circuit comprising first and second capacitors connected in series across said ballast output, said first capacitor being connected across an automatic switch connected in series with a primary winding of a transformer, said transformer having a secondary winding connected between said ballast output and an input terminal of said high intensity discharge lamp, said starting circuit further comprising a resistor connected across said second capacitor and having a terminal connected to a common terminal of said high intensity discharge lamp;

charging said first capacitor to a break-over voltage;

closing said switch; and transferring energy from said first capacitor to said primary winding of said transformer, and thereby generating a high frequency pulse across said input terminal and common terminal of said high intensity discharge lamp.

24. The method of claim 23, wherein said first and second capacitors are selected to present a low impedance path to said high frequency pulse.

25. The method of claim 24, wherein said transformer is saturated at an operating frequency.

26. The method of claim 24, wherein said transformer includes a tertiary winding connected between said ballast output and said common terminal of said high intensity discharge lamp.

27. The method of claim 24, wherein said distance is greater than two feet.

28. The method of claim 24, wherein said distance is greater than seventy five feet.

29. A method of igniting a high intensity discharge lamp comprising the steps of:

providing a starting circuit at a distance from a ballast output, said starting circuit comprising a first capacitor comprising a first capacitor terminal connected to said ballast output, said first capacitor being connected across an automatic switch connected in series with a primary winding of a transformer, said transformer having a secondary winding connected between said ballast output and an input terminal of said high intensity discharge lamp, said starting circuit further comprising a resistor connected to a second terminal of said first capacitor and to a common terminal of said high intensity discharge lamp, said starting circuit further comprising a second capacitor connected across said ballast output;

charging said first capacitor to a break-over voltage;

closing said switch; and transferring energy from said first capacitor to said primary winding of said transformer, and thereby generating a high frequency pulse across said input terminal and common terminal of said high intensity discharge lamp.

30. The method of claim 29, wherein said second capacitors is selected to present a low impedance path to said high frequency pulse.

31. The method of claim 29, wherein said transformer is saturated at an operating frequency of said ballast.

32. The method of claim 29, wherein said transformer includes a tertiary winding connected between said ballast output and said common terminal of said high intensity discharge lamp.

33. The method of claim 29, wherein said distance is greater than two feet.

34. The method of claim 29, wherein said distance is greater than seventy five feet.

35. An ignitor circuit for a discharge lamp, comprising:

a voltage input terminal connected to the output of a ballast;

an ignitor output terminal;

a first capacitor having first and second capacitor terminals, said first capacitor terminal being connected to said voltage input terminal;

a transformer having a primary winding inductively coupled to a secondary winding;

an automatic switch connected in series with said primary winding, said switch and primary winding being connected across said first capacitor, said secondary winding being connected to said voltage input terminal and said ignitor output terminal;

a resistor connected between said second capacitor terminal and a common terminal; and a second capacitor connected across said resistor.

36. An ignitor circuit as in claim 1, wherein said automatic switch is a spark gap device.

37. An ignitor circuit as in claim 1, wherein said automatic switch is a semiconductor switch.

38. An ignitor circuit as in claim 1, wherein said discharge lamp is a high intensity discharge lamp.

39. An ignitor circuit as in claim 1, wherein said automatic switch switches at a voltage greater than the operating voltage of said discharge lamp.

40. An ignitor circuit as in claim 1, wherein said secondary winding is saturated at an input voltage frequency.

41. An ignitor circuit as in claim 1, wherein said second capacitor is selected to provide a low impedance path for a starting pulse generated by said transformer.

* * * * *